US007204530B2

(12) United States Patent
Lee

(10) Patent No.: US 7,204,530 B2
(45) Date of Patent: Apr. 17, 2007

(54) VEHICLE DOOR INSIDE HANDLE ASSEMBLY

(75) Inventor: Jae Kyung Lee, Seoul (KR)

(73) Assignee: Hyundai Motor Company, Seoul (KR)

( * ) Notice: Subject to any disclaimer, the term of this patent is extended or adjusted under 35 U.S.C. 154(b) by 176 days.

(21) Appl. No.: 11/021,810

(22) Filed: Dec. 22, 2004

(65) Prior Publication Data

US 2005/0230982 A1 Oct. 20, 2005

(30) Foreign Application Priority Data

Apr. 14, 2004 (KR) ..... 10-2004-0025569

(51) Int. Cl.
*E05B 3/00* (2006.01)
*E05B 1/00* (2006.01)

(52) U.S. Cl. ..... 292/336.3; 292/347

(58) Field of Classification Search ..... 292/336.3, 292/161, 158, 347, DIG. 23, DIG. 30, DIG. 65, 292/DIG. 31, DIG. 62
See application file for complete search history.

(56) References Cited

U.S. PATENT DOCUMENTS 3,993,338 A * 11/1976 Cherbourg et al. ..... 292/336.3
4,482,179 A * 11/1984 Johnson ..... 292/336.3
4,889,373 A * 12/1989 Ward et al. ..... 292/336.3
5,558,372 A * 9/1996 Kapes et al. ..... 292/336.3
5,975,597 A * 11/1999 Makiuchi et al. ..... 292/336.3
6,158,788 A * 12/2000 Ikeda et al. ..... 292/216
6,609,737 B2 * 8/2003 Fisher ..... 292/216

* cited by examiner

*Primary Examiner*—Brian E. Glessner
*Assistant Examiner*—Kristina Gluchowski
(74) *Attorney, Agent, or Firm*—Morgan Lewis & Bockius LLP

(57) ABSTRACT

The present invention relates to a door inside handle assembly for vehicles, in which a door inside handle is mounted in a housing installed in a door trim in such a fashion as to be pivotally moved inwardly into the inner space of the housing by means of the pushing force of a driver or passenger, and a separate linkage mechanism for converting the pivotal force of the handle which is exerted toward the interior of the housing into the pulling force of the rod member is additionally installed between the handle and a rod member which is connected to a door locking latch and is positioned opposite to a door trim so as to allow a driver or passenger to simultaneously unlock and open the door while outwardly pushing the door inside handle, thereby improving convenience of manipulation.

15 Claims, 4 Drawing Sheets

VEHICLE DOOR INSIDE HANDLE ASSEMBLY

CROSS-REFERENCE TO RELATED APPLICATIONS

This application claims priority of Korean Application No. 10-2004-0025569, filed on Apr. 14, 2004, the disclosure of which is incorporated herein by reference.

BACKGROUND OF THE INVENTION

1. Field of the Invention

The present invention relates to a vehicle's inside door handle assembly, and more particularly to a vehicle's inside door handle assembly that has a handle mounted in a housing installed in a door trim in such a manner as to be moved pivotally inwardly into the inner space of the housing by a pushing force of a driver or passenger to allow an automobile door to be unlocked and opened.

2. Background of the Related Art

In general, a door latch assembly for vehicles is installed between a door trim and inner panel to allow for both the opening/closing function and the locking/unlocking function of a door. In addition, an inside door handle assembly and an outside door handle assembly are installed at the interior and exterior of the door, respectively. Respective rod members of the door inside and outside handle assemblies are operated in cooperation with each other in response to the manipulation of the door handle assemblies while a door latch is separated from a door lock striker to open the door.

Typically, where a driver or passenger gets out of a car, he or she first pulls the inside door handle toward himself or herself to unlock the door, and then pushes the door to open the door. However, however, in order for a driver or passenger to open the door when getting out of the car, he or she suffers an inconvenience of pulling the inside door handle toward himself or herself to unlock a door, and then outwardly pushing the door in an opposite direction to a direction of the pulling movement of the handle to thereby completely open the door, thereby requiring pulling and subsequent pushing motions.

SUMMARY OF THE INVENTION

Therefore, the present invention has been made in view of the above problems occurring in the prior art, and it is an object of the present invention to provide a door inside handle assembly for vehicles, in which a door inside handle is mounted in a housing installed in a door trim in such a fashion as to be pivotally moved inwardly into the inner space of the housing by means of the pushing force of a driver or passenger, and a separate linkage mechanism for converting the pivotal force of the handle which is exerted toward the interior of the housing into the pulling force of the rod member is additionally installed between the handle and a rod member which is connected to a door locking latch and is positioned opposite to a door trim so as to allow a driver or passenger to simultaneously unlock and open the door while outwardly pushing the door inside handle, thereby improving convenience of manipulation.

To accomplish the above object, according to the present invention, there is provided a door inside handle assembly for vehicles, in which a door inside handle is pivotally moved in a housing installed in a door trim so as to pull a rod member positioned opposite to the door trim such that a door latch is unlocked, the door inside handle assembly including: a housing securely fastened to a door inner panel positioned opposite to the door trim while being fit into a mounting aperture of the door trim, the housing having a hollow space defined therein; a door inside handle formed at one end with a hole for inserting a hinge pin thereto and an extended piece bent pointing to the inner space of the housing at a given angle with respect to the hinge pin, the extended piece having a connection pin formed at one end thereof, the handle being mounted in the housing in such a fashion as to be pivotally moved inwardly into the inner space of the housing about the hinge pin to its unlatching position by means of the pushing force of a driver or passenger exerted toward the interior of the housing and to be returned to its latching position by means of a resilient restoration force of the spring when the pulling force is released; and a linkage mechanism connected between one end of the handle and one end of the rod member via a through-hole of the housing, for converting the pivotal force of the handle exerted toward the interior of the housing into the pulling force of the rod member.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENTS

Reference will now made to the preferred embodiments of the present invention with reference to the attached drawings. The present invention is directed to a vehicle's inside door handle assembly, in which a door inside handle is mounted in a housing installed in a door trim in such manner as to be moved pivotally inwardly into the inner space of the housing by a driver or passenger pushing the handle. A separate linkage mechanism converts the pivotal force of the handle which is directed toward the interior of the housing into the pulling force of the rod member. The linkage mechanism is installed between the handle and a rod member connected to a door locking latch and positioned opposite to a door trim so as to allow a driver or passenger to simultaneously unlock and open the door while pushing the door inside handle outwardly, thereby improving convenience of manipulation.

Figure 1:
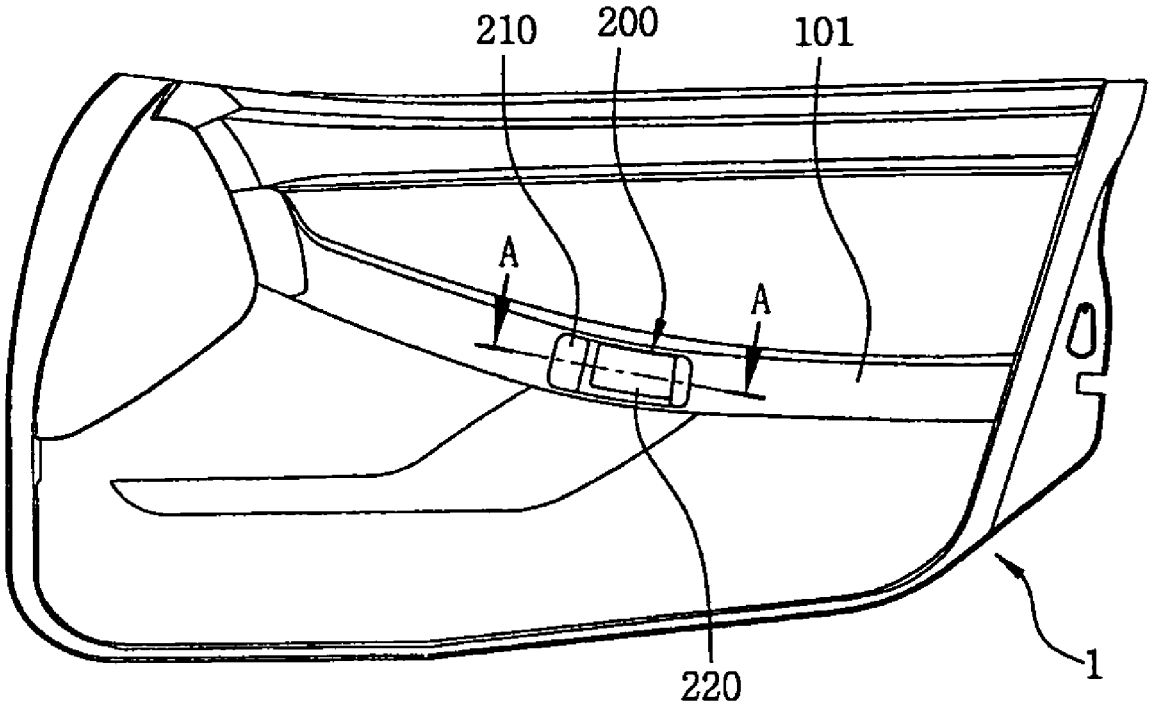
FIG. 1 is an inner perspective view illustrating an automobile door in which a door inside handle assembly is installed in accordance with the present invention.
Figure 2:
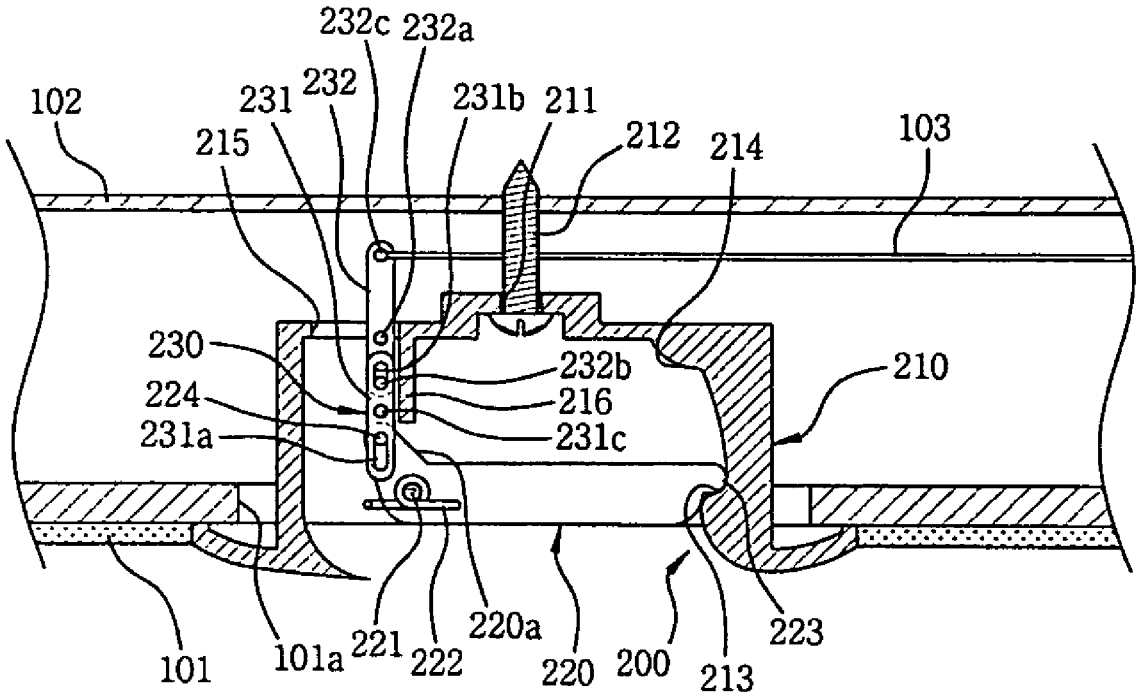
FIG. 2 is a cross-sectional view taken along the line A–A' of FIG. 1.

FIG. 1 is an inner perspective view illustrating an automobile door in which a door inside handle assembly is installed in accordance with the present invention, and FIG. 2 is a cross-sectional view taken along the line A–A' of FIG. 1. Referring to FIG. 1, a door inside handle assembly 200 of the present invention also functions as a conventional door grip, and hence only the door inside handle assembly 200 is installed on the door trim 101 without the door grip. In addition, a housing 21 having a hollow space defined therein is securely fastened to a door inner panel 102 by means of a screw 212 through a fastening hole 211 thereof while being fit into a mounting aperture 101*a* of the door trim 101. In this configuration, a door handle 220 influenced by the resilience of a spring 222 is pivotally mounted inside the housing 210 in such a fashion to be horizontally positioned adjacent to the door trim.

The handle 220 is constructed in the form of a bar substantially larger in size than a conventional handle, such that it can serve as a conventional door grip. The handle 220 also is configured such that a driver or passenger can outwardly push a middle portion thereof while grasping it with his or her hand. That is, in this embodiment, the handle 220 is configured such that the driver or passenger outwardly pushes the handle after putting his or her finger tips into a space defined between the middle inner portion of the handle 220 and the housing 210 and grasping the handle 220 with his or her hands.

Further, the handle 220 is formed at one end with a hole for inserting a hinge pin 221, fixedly installed to the upper and lower portions of the housing 210, thereto, such that the handle is pivoted inwardly into the inner space of the housing 210 about the hinge pin 221. In this case, a spring 222 is wrapped around the hinge pin 221 so that the handle 220 can be resiliently activated.

The handle 220 is pivoted inwardly into the inner space of the housing 210 by a pushing force of a driver or passenger exerted toward the interior of the housing 210 to its unlatching position. Afterward, when the pushing force is released, the handle 220 is returned to its latching position by means of a resilient restoration force of the spring 222.

The handle 210 is connected at one end to a linkage mechanism 230 which will be described later, and formed at the other end with a latching hook 223. One end of an inner surface of housing 210 is formed with a protruding latching jaw 213 that corresponds to the latching hook 223 of the handle 220. This allows the latching hook 223 to be caught on the latching jaw 213 toward the exterior of the housing. This restricts the pivotal movement of the handle 220 so as to prevent the handle from being pivoted outwardly from the inner space of the housing 210. Unless the pushing force of a driver or passenger is not exerted toward the interior of the housing 210, the pivotal movement of the handle 220 is restricted in such a fashion that the latching hook 223 thereof is caught on an inward portion of the latching jaw 213 of the housing 210.

In addition, at a corner portion of an inner surface of the housing 210 is a protruding rotation-preventing step 214 for preventing the handle 220 from excessively swinging in a state in which the door is unlocked. The rotation-preventing step 214 serves to restrict the swinging movement of the handle 220 so as to prevent the handle 220 from being pivoted inwardly into the inner space of the housing 210 while catching the latching hook 223 of the handle 220 after the unlocking movement of the door has been accomplished. Also, the rotation-preventing step 214 restricts the swinging movement of the handle 220 so as to secure a free space defined between the inner surface of the handle and the inner surface of the housing 210. The free space functions as a finger manipulation space for allowing a driver or passenger's finger tips to be inserted therein such that his or her fingers grasping the handle 220 are prevented from being pressed against the inner surface of the housing 210.

In the meantime, a distal end portion of the door inside handle 220 in which the hinge pin 221 is mounted, i.e., an extended piece 220*a* to which the linkage mechanism 230 is connected at one end thereof, is bent pointing to the inner space of the housing at a given angle with respect to the hinge pin 221. The extended piece 220*a* is provided at one end with a connection pin 224 so that the handle 220 and the linkage mechanism 230 are coupled to each other by means of the connection pin 224.

The linkage mechanism 230 is a device for allowing the unlocking movement of the door to be performed in an opposite direction to that of a conventional door unlocking movement. The linkage mechanism 230 is connected between the handle 220 and the rod member 103 coupled to a door latch (not shown) so that when a driver or passenger inwardly pushes the door inside handle 220 toward the interior of the housing 210 the rod member is pulled laterally.

Namely, the linkage mechanism 230 serves to convert the pivotal force of the handle 220 exerted toward the interior of the housing 210 into the pulling force of the rod member 103. The linkage mechanism 230 is connected at the other end to the rod member 103 via a through-hole 215 formed at one side of the inner surface of the housing 210. In a preferred embodiment, the linkage mechanism 230 includes a first linkage rod 231 connected at one end to the extended piece 220*a*, and a second linkage rod 232 connected at one end to the other end of the first linkage rod 231 and at the other end to one end of the rod member 103.

The first linkage rod 231 is longitudinally formed at both ends with opposite guide slots 231*a* and 231*b*. The first linkage rod 231 is also formed at the central portion thereof with a first pin-mounting hole for inserting a hinge pin 231*c* thereto. In this embodiment, the hinge pin 231*c* is fixedly mounted to the interior of the housing 210. The hinge pin 231*c* is fit into the first pin-mounting hole of the first linkage rod 231 so that the first linkage rod 231 can be pivotally rotated about the hinge pin 231*c*.

The first linkage rod 231 is coupled with the door inside handle 220 in such a fashion that the connection pin 224 of the handle 220 is slidably fit into the guide slot 231*a* formed at one end of the first linkage rod 231. Thus, the connection pin 224 of the handle 220 is slidably guided in the guide slot 231*a* upon the pivotal rotation of the first linkage rod 231.

The second linkage rod 232 is formed at the central portion thereof with a second pin-mounting hole for inserting a hinge pin 232*a* therein. In this embodiment, the hinge pin 232*a* is also fixedly mounted to the interior of the housing 120. The hinge pin 232*a* is fit into the second pin-mounting hole of the second linkage rod 232 so that the second linkage rod 232 can be pivotally rotated about the hinge pin 232*a*. The second linkage rod 232 is provided at one end with a connection pin 232*b*. Thus, The second linkage rod 232 is coupled with the first linkage rod 231 in such a fashion that the connection pin 232*b* of the second linkage rod 232 is slidably fit into the guide slot 231*b* formed at the other end of the first linkage rod 231 and positioned opposite to the guide slot 231*a*. The second linkage rod 232 is connected at the other end to one end of the rod member 103, which is in turn connected at the other end to a door latch.

Of course, when the handle 220 is pivoted inwardly into the inner space of the housing 210 to its unlatching position, the connection pin 232*b* of the second linkage rod 232 is slidably guided in the guide slot 231*b* of the first linkage rod 231.

The linkage mechanism 230 is activated only in a small inner space defined between an inner side wall surface of the housing 210 and an inner wall 216 extending inwardly from a side wall of the housing 210 to be adjacent to the through-hole 215 formed in a portion of the side wall of the housing. In this case, the second linkage rod 232 of the linkage mechanism 230 is extended at the other end to the exterior of the housing 210 through the through-hole 215. The small inner space of the housing is just an actuation space of the linkage mechanism 230.

Figure 3A:
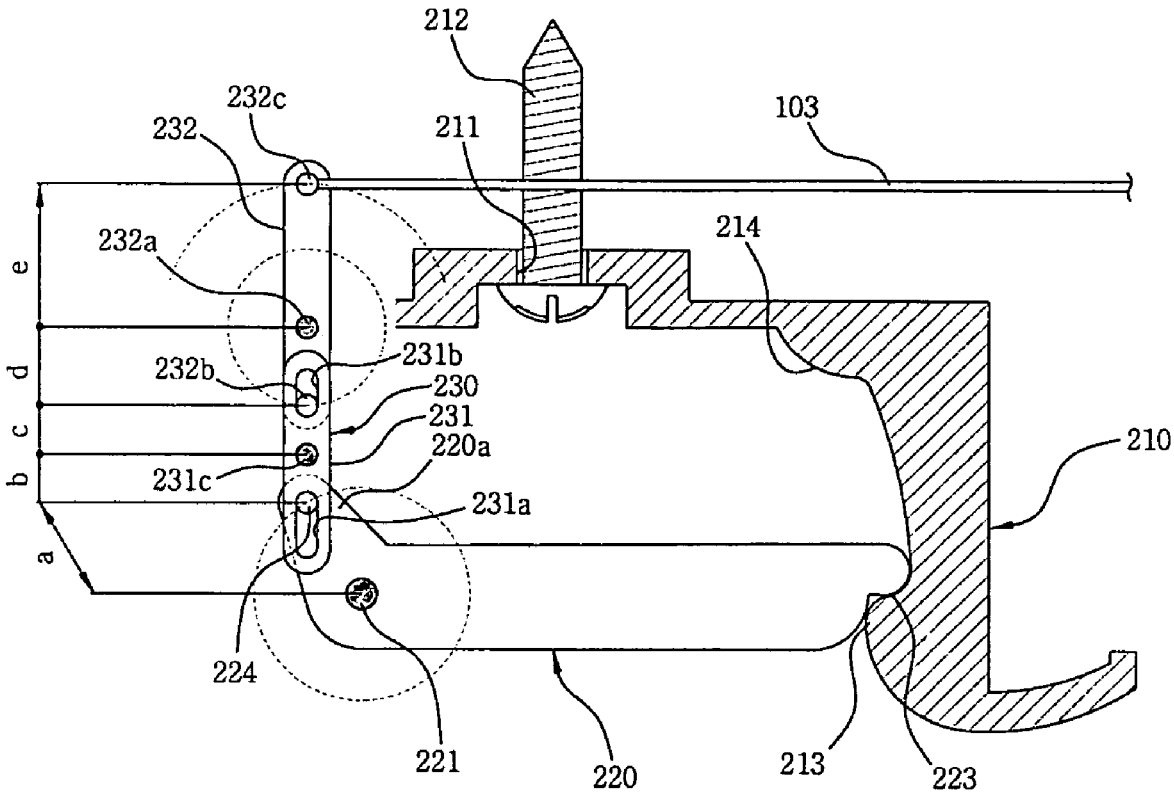
FIGS. 3*a* and 3*b* are views illustrating both the locked and unlocked configurations of the door inside handle assembly in accordance with the present invention, respectively.

Moreover, in this embodiment, in order to improve actuation efficiency of the linkage mechanism 230, the distance "a" between the hinge pin 221 and the connection pin 224 of the handle 220 is set to be larger than the distance "b" between the connection pin 224 of the handle 220 and the hinge pin 231*c* of the first linkage rod 231. In this case, the connection pin 224 is positioned at an end of the guide slot 231*a* of the first linkage rod 231. Also, the distance "e" between the hinge pin 232*a* of the second linkage rod 232 and the coupling portion 232*c* of the second linkage rod 232 to the rod member 103 and the is set to be larger than the distance "d" between the hinge pin 232*a* and the connection pin 232*b* of the second linkage rod 232. In this case, the connection pin 232*b* is positioned at an end of the guide sot 231*b* of the first linkage rod 231 to be opposite to each other with respect to the hinge pin 231*c* of the first linkage rod 231. As a result, the rod member can be sufficiently pulled even with less movement and force "a," "b," "c," "d," and "e," as shown in FIG. 3A.

Figure 3B:
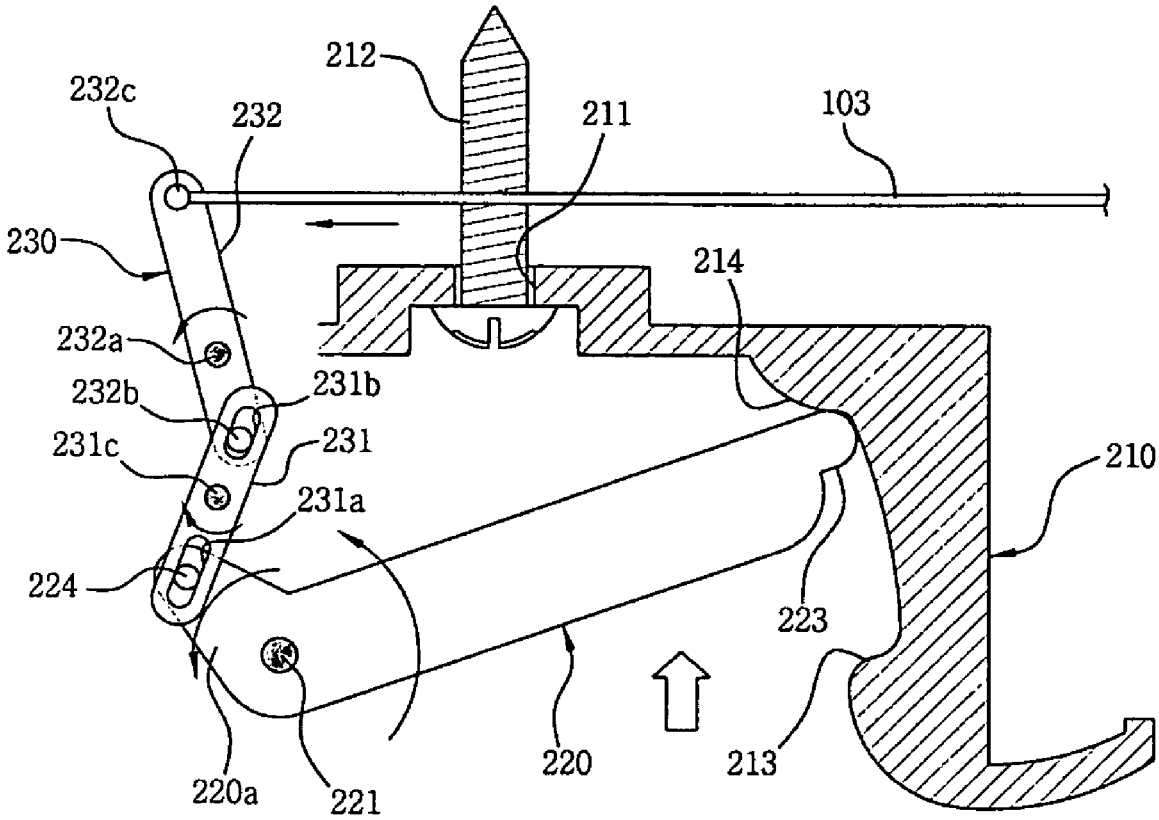

The operation of the door inside handle assembly of the present invention will be described in detail hereinafter with reference to FIGS. 3*a* and 3*b*. FIGS. 3*a* and 3*b* are views illustrating both the locked and unlocked configurations of the door inside handle assembly in accordance with the present invention, respectively. Referring to the drawings, when a driver first pushes the handle 220 toward the interior of the housing 210 while grasping it with his or her hand, the handle 220 is pivoted about the hinge pin 221 thereof in a counterclockwise direction as indicated in FIG. 3*b* to its unlatching position.

In this case, the extended piece 220*a* of the handle 220 travels along the locus of a circle so that the connection pin 224 of the handle 220 is slidably guided in the guide slot 231*a* of the first linkage rod 231 while the first linkage rod 231 is pivotally rotated about the hinge pin 231*c* thereof in a clockwise direction as indicated in FIG. 3*b*, i.e., in an opposite direction to the pivotal direction of the handle 220.

In addition, when the first linkage rod 231 is pivotally rotated as above, the connection pin 232*b* of the second linkage rod 232 is slidably guided in the guide slot 231*b* of the first linkage rod 231 while the second linkage rod 232 being pivotally rotated about the hinge pin 232*a* thereof in a counterclockwise direction as indicated in FIG. 3*b*. i.e., in an identical direction to the pivotal direction of the handle 220, at which time the rod member 103 is pulled in an arrow direction as shown in FIG. 3*b*.

Therefore, in the automobile door inside handle assembly of the present invention, when a driver or passenger pushes the handle 220 toward the interior of the housing 210, the handle 220 is pivoted about the hinge pin 221 coupled to the housing 210 in a counterclockwise direction to its unlatching position such that its pivotal force is transmitted to the linkage mechanism 230 which in turn converts the pivotal force of the handle into the pulling force of rod member 103 for transmission to the rod member 103. The rod member 103 is pulled by the linkage mechanism 230 and simultaneously unlocked the door latch. As such, in the present invention, when a driver or passenger pushes the handle 220 in a direction in which the door 1 is opened while grasping it with his or her hand, both the unlocking and opening of the door is performed simultaneously.

As described above, according to the automobile door inside handle assembly of the present invention, a door inside handle is mounted in a housing installed in a door trim in such a fashion as to be pivotally moved inwardly into the inner space of the housing by means of the pushing force of a driver or passenger, and a separate linkage mechanism for converting the pivotal force of the handle which is exerted toward the interior of the housing into the pulling force of the rod member is additionally installed between the handle and a rod member which is connected to a door locking latch and is positioned opposite to a door trim so that a driver or passenger can simultaneously unlock and open the door while pushing the door inside handle outward, thereby improving convenience of manipulation.

Furthermore, the inventive door inside handle assembly also serves as a conventional door grip with which to push and open the door, and hence the need for the installation of a separate door grip is eliminated, which results in a reduction in the number of automobile parts and the manufacturing cost.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A vehicle inside door handle assembly, comprising:

a housing securely fastened to a door inner panel positioned opposite to a door trim while being fit into a mounting aperture of the door trim, the housing having a hollow space defined therein;

a door inside handle installed so as to pull a rod member positioned opposite to the door trim such that a door latch is unlocked, wherein the handle is formed at one end with a hole for inserting a hinge pin thereto and an extended piece bent pointing to the inner space of the housing at a given angle with respect to the hinge pin, the extended piece having a connection pin formed at one end thereof, the handle being mounted in the housing to be pivotally moved inwardly into the inner space of the housing about the hinge pin to its unlatched position by means of a pushing force of a driver or passenger exerted toward the interior of the housing and to be returned to its latched position by means of a resilient restoration force of the spring when the pushing force is released; and a linkage mechanism connected between one end of the handle and one end of the rod member via a through-hole of the housing, for converting the pivotal force of the handle exerted toward the interior of the housing into the pulling force of the rod member; wherein the linkage mechanism includes:

a first linkage rod connected at one end to the extended piece of the handle, the first linkage rod being longitudinally formed at both ends thereof with opposite guide slots and at a central portion thereof with a first pin mounting hole for inserting a first hinge pin for fixedly mounting to the housing, so that the first hinge pin is fit into the first pin mounting hole of the first linkage rod to allow the first linkage rod to pivotally rotate about the first hinge pin while the first connection pin of the extended piece being slidably guided in a guide slot formed at one end of the first linkage rod; and a second linkage rod connected at one end to the other end of the first linkage rod and connected at the other end to one end of the rod member, the second linkage rod being formed at the central portion thereof with a second pin mounting hole for inserting a second hinge pin for fixedly mounting to the housing and formed at one end with a second connection pin, so that the second hinge pin is fit into the second pin mounting hole of the second linkage rod to allow the second linkage rod to pivotally rotate about the second hinge pin while the second connection pin is slidably guided in a guide slot formed at the other end of the first linkage rod, whereby when the handle is pivoted inwardly into the inner space of the housing to its unlatched position the first and second linkage rods are pivotally rotated about the first and second hinge pins, respectively, in an opposite direction to each other to thereby pull the rod member.

2. The vehicle inside door handle assembly according to claim 1, wherein the door inside handle is formed at the other end with a latching hook, and the housing a latching jaw formed at one end of an inner surface thereof that corresponds to the latching hook of the handle so that the latching hook is caught on the latching jaw toward the exterior of the housing.

3. The vehicle inside door handle assembly according to claim 1, wherein a corner portion of an inner surface of the housing forms a rotation-preventing step for preventing the handle from being pivoted excessively inwardly into the inner space of the housing while catching the latching hook of the handle after the unlocking movement of the door has been performed, so as to secure a free space defined between the inner surface of the handle and the inner surface of the housing in a state in which the handle has been maximally pivoted inwardly into the inner space of the housing.

4. The vehicle inside door handle assembly according to claim 2, wherein a corner portion of an inner surface of the housing forms a rotation-preventing step for preventing the handle from being pivoted excessively inwardly into the inner space of the housing while catching the latching hook of the handle after the unlocking movement of the door has been performed, so as to secure a free space defined between the inner surface of the handle and the inner surface of the housing in a state in which the handle has been maximally pivoted inwardly into the inner space of the housing.

5. A vehicle inside door handle assembly comprising:

a linkage mechanism having a first end and a second end, wherein the first end is configured to be coupled to a door latch;

a housing configured to be coupled to an inner door inner panel, the housing having a hollow space defined therein;

an inside door handle pivotally mounted within said hollow space, wherein said handle is coupled to said linkage mechanism so as to be pivotally moved inwardly into the hollow space of the housing to unlock the door latch via the linkage mechanism; wherein the linkage mechanism includes:

a first linkage rod connected at one end to the extended piece of the handle, the first linkage rod being longitudinally formed at both ends thereof with opposite guide slots and at a central portion thereof with a first pin mounting hole for inserting a first hinge pin for fixedly mounting to the housing, so that the first hinge pin is fit into the first pin mounting hole of the first linkage rod to allow the first linkage rod to pivotally rotate about the first hinge pin while the first connection pin of the extended piece being slidably guided in a guide slot formed at one end of the first linkage rod; and a second linkage rod connected at one end to the other end of the first linkage rod and connected at the other end to one end of the rod member, the second linkage rod being formed at the central portion thereof with a second pin mounting hole for inserting a second hinge pin for fixedly mounting to the housing, and formed at one end with a second connection pin, so that the second hinge pin is fit into the second pin mounting hole of the second linkage rod to allow the second linkage rod to pivotally rotate about the second hinge pin while the second connection pin being slidably guided in a guide slot formed at the other end of the first linkage rod, whereby when the handle is pivoted inwardly into the inner space of the housing to its unlatched position the first and second linkage rods are pivotally rotated about the first and second hinge pins, respectively, in an opposite direction to each other to thereby pull the linking mechanism.

6. The vehicle inside door handle assembly of claim 5, further comprising a resilient member for forcing said handle away from said housing.

7. The vehicle inside door handle assembly of claim 5, further comprising a rod member coupled between said linking member and said door latch.

8. The vehicle inside door handle assembly of claim 5, wherein said housing is fastened to a door inner panel positioned opposite to a door trim while being fit into a mounting aperture of the door trim.

9. The vehicle inside door handle assembly of claim 5, wherein said handle forms a hole at one end for inserting a hinge pin therein.

10. The vehicle inside door handle assembly of claim 8, wherein said handle includes an extended piece bent towards the inner space of the housing at a given angle with respect to the hinge pin.

11. The vehicle inside door handle assembly of claim 9, wherein said extended piece has a connection pin formed at one end thereof.

12. The vehicle inside door handle assembly of claim 10, wherein said handle is configured to be pivotally moved inwardly into the inner space of the housing about the hinge pin to its unlatched position by means of a pushing force of a person exerted toward the interior of the housing and returns to a latched position by means of a resilient restoration force of a spring when the pushing force is released.

13. The vehicle inside door handle assembly of claim 10, wherein the linkage mechanism is connected between one end of the handle and one end of a rod member via a through-hole of the housing, for converting the pivotal force of the handle exerted toward an interior of the housing into the pulling force of the rod member.

14. The vehicle inside door handle assembly of claim 5, wherein the door inside handle is formed at the other end with a latching hook, and one end of an inner surface of the housing forms a latching jaw correspondingly to the latching hook of the handle so that the latching hook is caught on the latching jaw toward the exterior of the housing.

15. The vehicle inside door handle assembly of claim 13, wherein a corner portion of an inner surface of the housing forms a rotation-preventing step for preventing the handle from being pivoted excessively inwardly into the inner space of the housing while catching the latching hook of the handle after the unlocking movement of the door has been performed, so as to secure a free space defined between the inner surface of the handle and the inner surface of the housing in a state in which the handle has been maximally pivoted inwardly into the inner space of the housing.

* * * * *